US009555534B2

(12) United States Patent
Le Du et al.

(10) Patent No.: US 9,555,534 B2
(45) Date of Patent: Jan. 31, 2017

(54) ROTARY SCREW DRIVING TOOL WITHOUT REACTIONARY FORCE IN THE HANDLE

(71) Applicant: Etablissements Georges Renault, Saint-Herblain (FR)

(72) Inventors: Nicolas Le Du, Coueron (FR); Damien Limousin, La Guyonniere (FR)

(73) Assignee: ETABLISSEMENTS GEORGES RENAULT, Saint-Herblain (FR)

( * ) Notice: Subject to any disclaimer, the term of this patent is extended or adjusted under 35 U.S.C. 154(b) by 534 days.

(21) Appl. No.: 14/045,410

(22) Filed: Oct. 3, 2013

(65) Prior Publication Data

US 2014/0096989 A1 Apr. 10, 2014

(30) Foreign Application Priority Data

Oct. 5, 2012 (FR) ..... 12 59458

(51) Int. Cl.

| | |
|---|---|
| ***B25F 5/00*** | (2006.01) |
| ***B25F 5/02*** | (2006.01) |
| ***B25B 23/00*** | (2006.01) |
| ***B25B 21/00*** | (2006.01) |

(52) U.S. Cl.

CPC ..... *B25F 5/001* (2013.01); *B25B 21/00* (2013.01); *B25B 23/0078* (2013.01); *B25F 5/025* (2013.01)

(58) Field of Classification Search

CPC ..... B25F 5/001–5/006; F16H 1/2818
USPC ..... 173/216; 475/248, 337, 317
See application file for complete search history.

(56) References Cited

U.S. PATENT DOCUMENTS 3,393,584 A * 7/1968 Cleff ..... F16D 3/56 475/347
4,448,098 A * 5/1984 Totsu ..... B25B 15/04 81/467
5,238,461 A * 8/1993 Gotman ..... B25B 13/488 475/248
5,540,629 A * 7/1996 Gotman ..... B25B 13/488 475/248

(Continued)

FOREIGN PATENT DOCUMENTS

| | | |
|---|---|---|
| EP | 2127812 A1 | 12/2009 |
| FR | 2913361 A1 | 9/2008 |
| WO | 2009051543 A1 | 4/2009 |

OTHER PUBLICATIONS

French Search Report and Written Opinion dated Jun. 28, 2013 for corresponding French Patent Application No. 1259458, filed Oct. 5, 2012.

*Primary Examiner* — Thanh Truong
*Assistant Examiner* — Dariush Seif
(74) *Attorney, Agent, or Firm* — David D. Brush; Westman, Champlin & Koehler, P.A.

(57) ABSTRACT

A device is provided for screwing. The device includes a handle housing and a gear reduction housing. The handle housing includes a handle and lodges a motor. The gear reduction housing lodges a gear reduction unit, the input of which cooperates with the output of the motor. The gear reduction unit includes a single output cooperating with a rotating end element for cooperating with an element to be screwed. The gear reduction housing is linked to the handle housing by a rotating link. The rotating link is configured in a way such that a negligible reaction force is transmitted to the handle housing during an operation of screwing.

11 Claims, 3 Drawing Sheets

(56) References Cited

U.S. PATENT DOCUMENTS

| | | | | |
|---|---|---|---|---|
| 6,435,285 | B1 * | 8/2002 | Tsai | B25B 21/00 173/178 |
| 6,796,921 | B1 * | 9/2004 | Buck | B25F 5/001 173/47 |
| 7,413,025 | B2 * | 8/2008 | Provost | F16H 1/46 173/176 |
| 2007/0251359 | A1 | 11/2007 | Junkers et al. | |
| 2008/0287247 | A1 * | 11/2008 | Pusateri | B25B 21/00 475/272 |
| 2010/0108337 | A1 * | 5/2010 | Norona | B23B 45/008 173/1 |
| 2011/0308827 | A1 * | 12/2011 | Kaufmann | B25B 23/14 173/1 |
| 2012/0231923 | A1 * | 9/2012 | Fox | F03D 11/02 475/337 |

* cited by examiner

ROTARY SCREW DRIVING TOOL WITHOUT REACTIONARY FORCE IN THE HANDLE

1. FIELD OF THE INVENTION

The field of the invention is that of the designing and making of screw driving tools.

More specifically, the invention pertains to a screw driving tool, the housing of which comprises a portion with a handle and a portion housing a gear reduction unit, these portions being connected by a rotating junction.

2. PRIOR ART

Screwdrivers are commonly used essentially in industry to enable operators to carry out operations for screwing together elements for linking the parts forming an assembly.

Screwdrivers classically comprise a housing having a handle and lodging motor means, the output of which is connected to the input of a gear reduction unit, the output of this gear reduction unit being itself connected to a rotating end element for cooperating with an element to be screwed.

During the rotation of an element to be screwed, the reaction torque of the tool is appreciably greater than what an operator can sustain. Screwdrivers therefore often have a reaction bar fixedly attached to the housing. This reaction bar is designed to be placed so that it rests against a fixed element so that, during the screw driving operation, it absorbs the reaction torque of the tool.

In extreme and rare cases, it can happen that the reaction bar slips off the supporting point against which it is blocked. Such a situation may result in injury to the operator if he continues to press on the trigger.

To overcome this drawback, screwdrivers have been developed comprising firstly a handle housing having a handle and lodging motor means and secondly a gear reduction housing lodging a reduction gear. The gear reduction housing is fixedly attached to the handle housing by a rotating link. In other words, the handle housing and the gear reduction housing are mobile in rotation relative to each other.

Because of such an assembly, if there is any slippage, disconnection or breakage of the reaction bar during a screw driving operation, the gear reduction housing and the handle housing rotate relative to each other so that the reaction torque proportional to the output torque delivered by the screwdriver is not transmitted by the handle to the operator's hands.

Besides, such an assembly enables the operator to adjust the angular position of the handle relative to the gear reduction housing to find the working position that he feels is the most comfortable to carry out the screw driving operation for which he is responsible.

Screwdrivers of this type have the advantages of offering great safety of use as well as high ergonomy. They can nevertheless be even further improved.

3. DRAWBACKS OF THE PRIOR ART

Although the reaction transmitted by the handle to the operator's hand during a screw driving operation without reaction bar is relatively low, it is not completely negligible.

Indeed, the operator must in any case withstand the reaction torque generated by the internal transmission of the screwdriver at the rotating junction between the handle housing and the gear reduction housing. This torque corresponds actually to the torque of the motor means, i.e. the product of the motor torque multiplied by one or more possible reduction stages. Its value is generally situated in the range of 10 N.m. Such reaction torque levels are sufficient to cause fatigue for the operator.

4. SUMMARY OF THE INVENTION

An embodiment of the present invention relates to a device comprising a handle housing and a gear reduction housing, said handle housing comprising a handle and lodging motor means, said gear reduction housing lodging a gear reduction unit, the input of which cooperates with the output of said motor means, said gear reduction unit comprising a single output cooperating with a rotating end element for cooperating with an element to be screwed, said gear reduction housing being linked to said handle housing by rotating linking means.

According to the invention, said rotating linking means are configured in a way such that a negligible reaction force is transmitted to said handle housing during a screw driving operation.

Thus, the invention relies on a wholly original approach in which the reduction housing and the handle housing of a screwdriver are linked by means of rotating linking means designed in such a way that only a negligible reaction force is transmitted to the handle housing during a screw driving operation. The term "negligible reaction force" is understood to mean a force which is low enough not to risk causing injury or discomfort for the operator. In practice, the value of such a torque is generally less than 5 N.m.

When carrying out screw driving operation, no reaction force is therefore transmitted to the operator's hand by the handle.

The application of the technique of the invention therefore improves the safety of use of a screwdriver and improves its ergonomic qualities.

Preferably, said rotating linking means comprise means of transmission, to said handle housing, of a reaction torque having an intensity that is substantially identical, and a direction that is opposite, to that of the reaction torque transmitted by said gear reduction unit to said motor means.

When these reaction torque values are identical, no reaction force whatsoever is transmitted by the handle to the operator's hand. When these torques have different values, a reaction force is transmitted by the handle to the operator. The means of transmission will therefore be determined in such a way that the reaction forces transmitted to the operator are at most negligible, i.e. they are low enough not to cause any injuries for the operator or more simply to cause him any discomfort. In practice, the value of one of these reaction torques will be equal to that of the other plus or minus about 20%.

According to one particular embodiment, said gear reduction unit comprises a first epicyclic gear train having a first sun gear interdependent with said motor means, first planet gears mounted on a first planet carrier and an annulus or ring gear mounted freely in rotation in said gear reduction housing, said means of transmission comprising a second epicyclic train having a second sun gear mobile in rotation relative to said first sun gear and fixed to said handle housing, second planet gears mounted on a second planet carrier fixed to said gear reduction housing and said ring gear.

This implementation makes it possible to ensure, efficiently and simply, that only a zero or negligible reaction force is transmitted to the handle during a screw driving operation.

In this case, the numbers of gear teeth, respectively of the sun gear, the planet gears and the ring gear of the first epicyclic train are preferably identical to those of the sun gear, the planet gears and the ring gear of the second epicyclic train.

Taking the input of the first epicyclic train to be the sun gear and the output to be the planet carrier, the input of the second epicyclic train to be the sun gear and its output to be the planet carrier, said first and second trains have identical reduction ratios.

No reaction force is then transmitted to the handle.

A device according to the invention preferably comprises means for measuring a piece of information representing the tightening torque of said element to be screwed, said measuring means comprising at least one torque sensor integrated into said means of transmission.

It is thus possible, in the transmission unit, to measure a reaction torque due to the tightening, the value of which is proportional to that of the torque at which the element to be screwed is tightened by means of the screwdriver.

The torque sensor is preferably mounted on said second sun gear.

In one variant, the first planet carrier is directly connected to the rotating end member.

The means for transmitting and measuring are thus very close to the output of the transmission. The precision of measurement of the tightening torque is then improved.

Said sensor advantageously integrates strain gauges.

These strain gauges are connected to an electronic board lodged in the handle housing. This is made possible by the fact that the sun gear supporting the sensor is fixed to the handle housing, thus enabling the passage of wires for feeding the strain gauges and for recovering the signal.

In one particular variant, a device according to the invention comprises a gearbox interposed between said motor means and said gear reduction unit.

It is thus possible to implement screw driving phases at different speeds, such as for example a fast pre-screw driving phase and a slower screw driving phase.

In this case, a device according to the invention could include means for changing speed by inverting the sense of rotation of said motor means.

The passage from one speed to another could then be obtained simply by inverting the rotational sense of the motor.

In one particular variant, the axis of said gearbox and said gear reduction unit extends in parallel and in a way such that it is offset from the axis of said motor means.

It is thus possible to reduce the length of the screwdriver and produce a tool that is more compact and easier to handle.

A device according to the invention could include a reaction bar interdependent with said gear reduction housing.

An operator could thus block the screwdriver in rotation to ensure screw driving with high torque.

5. LIST OF FIGURES

Other features and advantages of the invention shall appear more clearly from the following description of a preferred embodiment given by way of a simple illustratory and non-exhaustive example and from the appended drawings, of which:

6. DESCRIPTION OF ONE EMBODIMENT OF THE INVENTION

6.1. Reminder of the Principle of the Invention

The general principle of the invention relies on the implementing of rotating linking means, between the gear reduction housing and the handle housing of a screwdriver, designed in such a way that no reaction force is transmitted to the handle housing during a screw driving operation.

Thus, no reaction force is transmitted by the handle to the operator during a screw driving operation. The operator therefore absorbs no reaction force The invention therefore provides an ergonomical screwdriver with increased safety of use.

6.2. Example of One Embodiment of the Invention

6.2.1. Architecture

Figure 1:
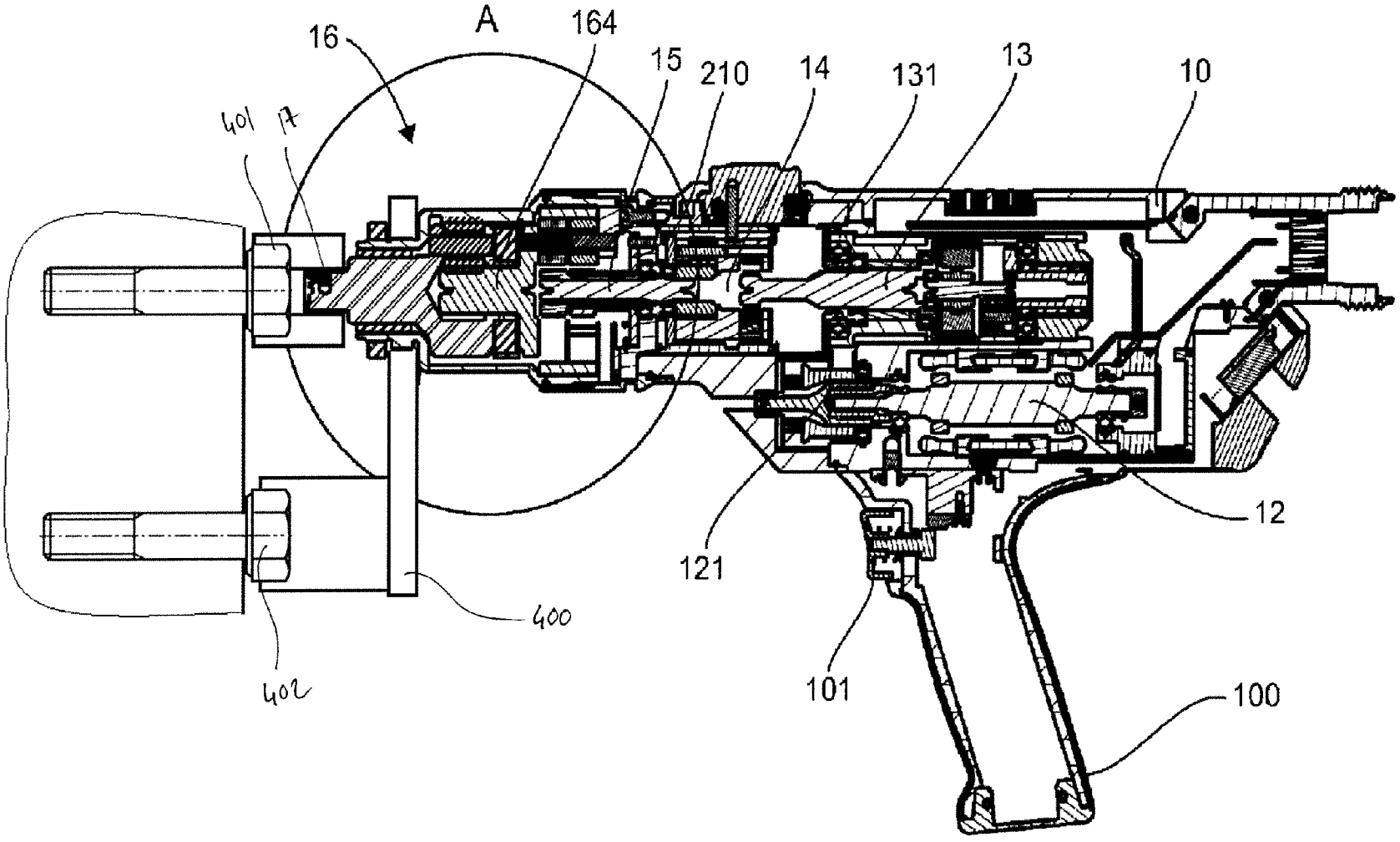
FIG. 1 illustrates a view in section of a screwdriver according to the invention along a median plane passing through its longitudinal axis.
Figure 2:
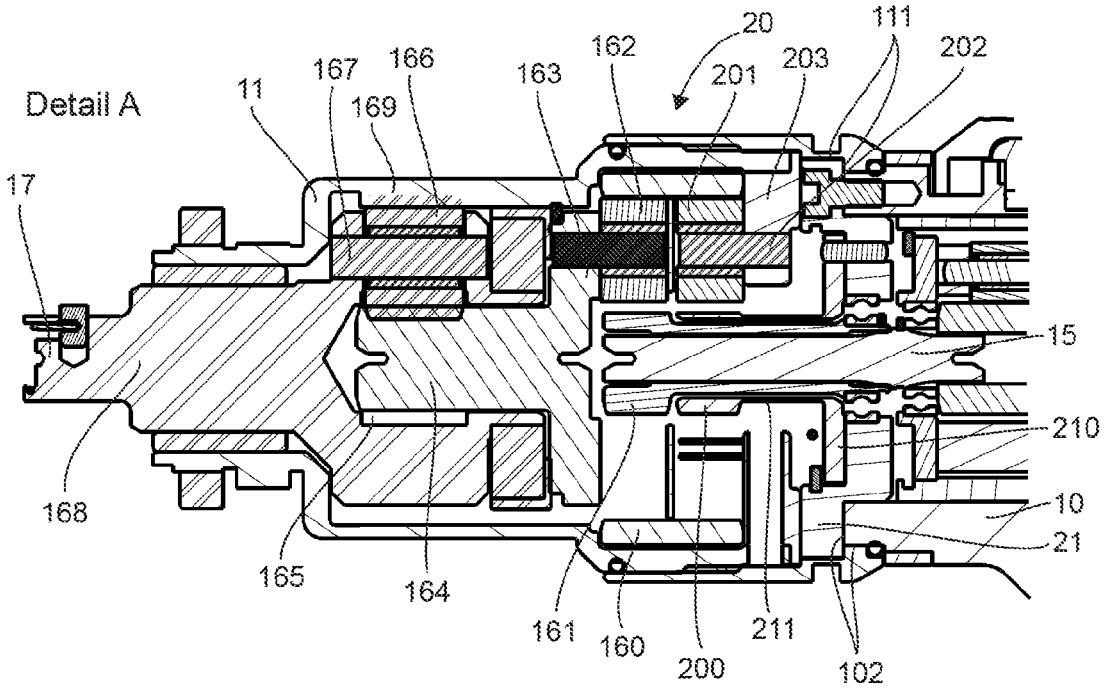
FIG. 2 illustrates a detailed view of the gear reduction housing and its junction with the handle housing of the screwdriver illustrated in FIG. 1.
Figure 3:
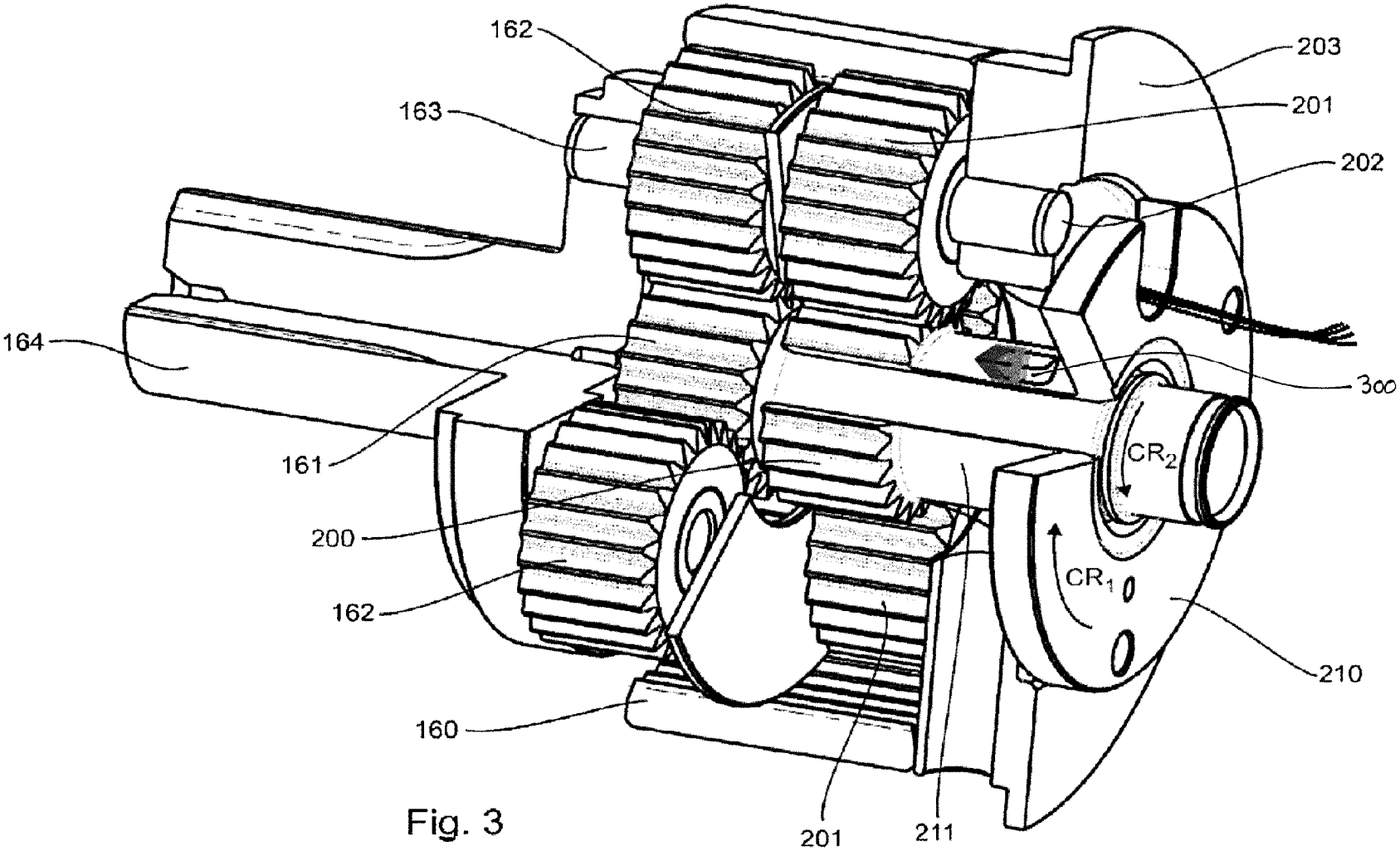
FIG. 3 illustrates a view in perspective of the gear reduction unit and its junction with the handle housing of the screwdriver illustrated in FIGS. 1 and 2.

Referring to FIGS. 1 to 3, we present an embodiment of a screwdriver according to the invention.

Thus, as shown in FIG. 1, a screwdriver of this kind comprises a handle housing 10 and a reduction-gear housing 11.

The handle housing 10 comprises a handle 100 and an actuating trigger 101. It lodges motor means which, in this embodiment, comprise:

- an electric motor 12;
- a gearbox 13 whose input 131 works with the output 121 of the motor 12 and means for changing speeds by an inversion of the rotational sense of the motor 12;
- manual inverting means 14 for inverting the sense of rotation of the end member 17.

In this embodiment, the output 121 of the motor 12 cooperates with the input 131 of the gearbox 13 through an intermediate transmission comprising an epicyclic train, of which the sun gear is interdependent with the output shaft of the motor 12, the ring gear is fixed, the planet carrier comprises an external set of teeth which meshes with pinions which themselves mesh with the input 131 of the gearbox.

The gearbox with gear shift by inversion of the sense of rotation of the motor is known per se and shall not be described here in detail. Such a gearbox is described for example in the patent application FR-A1-2 913 361.

The output of the gearbox is linked to a drive shaft 15 capable of being driven rotationally in one sense according to at least two speeds by the motor and the gearbox.

The inverting means 14 which are known per se to those skilled in the art and are not described in detail can enable an operator to invert the sense of rotation of the motor shaft 15 to carry out an unscrewing operation.

The gear reduction housing 11 lodges a gear reduction unit 16. This gear reduction unit comprises a single output provided to cooperate with a rotating end member 17 for cooperating with an element to be screwed in.

The gear reduction housing 11 is linked to the handle housing 10 by rotating linking means. To this end, a plain bearing is provided between the surface 111 of the gear reduction housing 11, the surface 102 of the handle housing 10 and the plate 21 whose implementation is described here below. The reduction gear housing 11 and the handle housing 10 can be therefore rotated relative to each other about the axis of rotation of the end member 17.

As shall be explained in greater detail here below, these rotating linking means are configured in such a way that no reaction force is transmitted during a screw driving operation to the handle housing 10.

In one variant, the screwdriver could have no gearbox or means for shifting gears by inversion of the sense of rotation of the motor. In this case, the output of the motor could be directly linked to the input of the gear reduction unit.

The gear reduction unit comprises a first epicyclic train. This first epicyclic train comprises a first sun gear 161 which is rotationally linked to the driveshaft 15. It also comprises first planet gears 162 mounted so as to be mobile in rotation on pins 163 interdependent with a first planet carrier 164, and a ring gear 160. The ring gear 160 is mounted so as to be rotationally mobile within the gear reduction housing 11.

In this embodiment, this gear reduction unit comprises another epicyclic train. This train comprises a sun gear 165 which is interdependent with the first planet carrier 164, planet gears 166 mounted so as to be rotationally mobile on pins 167 interdependent with a planet carrier 168, and a ring gear 169 fixed relative to the gear reduction housing 11 and meshing with the planet gears 166.

The end member 17 is fixedly attached to the planet carrier 168.

In variants, other reduction gear elements could be implemented upstream to the reduction gear 16.

The rotational linking means comprise means of transmission 20 to the handle housing 10 of a reaction torque with an intensity that is identical and a direction that is the opposite of that of the reaction torque transmitted by the gear reduction unit 16 to the motor means.

These means of transmission 20 comprise a second epicyclic train. This second epicyclic train comprises a second sun gear 200. This sun gear 200 is mounted so as to be rotationally mobile about a shaft formed in the extension of the first sun gear 161 and interdependent with it. It is prolonged by a shaft-forming portion 211 at the end of which a clamp 210 is placed. This clamp 210 is fixed to the handle housing 10 via a plate 21. This second epicyclic train comprises second planet gears 201 mounted so as to be mobile in rotation on pins 202 interdependent with a second planet carrier 203. This second planet carrier 203 is fixed to the gear reduction housing 11. The second planet gears mesh with the ring gear 160.

The number of teeth of the sun gear 161 is identical to that of the sun gear 200. The number of teeth of the planet gears 162 is identical to that of the planet gears 201. The portion of the ring gear 160 engaged with the planet gears 162 has a number of teeth identical to the portion of the ring gear 160 engaged with the planet gears 201.

If we consider the input of the first epicyclic train to be the sun gear 161 and its output to be the planet carrier 164, and the input of the second epicyclic train to be the sun gear 200 and its output to be the planet carrier 203, then the first and second epicyclic trains have identical reduction ratios.

The second planet carrier 203 is fixed relative to the gear reduction housing 11. The pins 202 are therefore fixed relatively to the gear reduction housing 11. The second planet gear 201 can rotate about the pins 202. The ring gear 160 is thus stopped in rotation in the gear reduction housing 11 although it is mounted therein freely in rotation, i.e. in a floating way. Since the ring 160 is floating, the handle housing 10 and the reduction housing 11 can rotate relative to each other.

The screwdriver comprises a reaction bar (400) which is fixedly attached to the gear reduction housing 11.

The screwdriver comprises means for measuring a piece of information representing the tightening torque to which there is screwed an element to be screwed by means of the screwdriver. These means for measuring comprise a torque sensor 300 which comprises strain gauges fixedly attached to the second sun gear 200.

The screwdriver is connected to driving means such as a control box (not shown).

6.2.2. Operation

In order to initiate a screw driving operation, the operator grasps the screwdriver and makes the rotating end member 17 cooperate with the element 401 to be screwed in. It thus blocks the reaction bar 400 against a fixed element 402 which is for example fixedly attached to the assembly to be made. He finally actuates the trigger 101 to turn on the motor 12.

The drive shaft 15 is then driven rotationally by the motor and the gearbox in the clockwise sense, seen from the rear of the motor, at a first fast speed known as the pre-screw driving speed.

The first sun gear 161 is driven rotationally in the clockwise sense by the drive shaft 15. The first planet gears 162 are driven in the counter-clockwise sense by the first sun gear 161. Since the ring gear 160 is held at a stop within the gear reduction housing 11 via the second epicyclic train, the first planet carrier 164 rotates in the clockwise sense. The sun gear 165 then rotates in a clockwise sense and drives the planet gears 161 in a counter-clockwise sense while the planet carrier 168 rotates in a clockwise sense. The end member 17 then rotates at high speed in the clockwise sense so much so that the element to be screwed undergoes a pre-screw driving phase. The screwdriver then delivers a given pre-screw driving torque.

During a screw driving operation, the ring gear 160 exerts a reaction torque on the second planet gears 201 tending to drive them in the counter-clockwise sense. Since the second planet carrier 203 is immobile, the second planet gears 201 exert a reaction torque tending to drive the second sun gear 200 in rotation in the clockwise sense. The second sun gear 200 therefore transmits a first reaction torque $CR_1$ in the clockwise sense, via the clamp 210, to the handle housing 10 to which it is fixedly attached.

Besides, the gear reduction unit 16 transmits a second reaction torque $CR_2$ in the counter-clockwise sense to the drive shaft 15 via the first sun gear 161.

Since the reduction ratios of the first and second epicyclic trains are identical, the value of the first and second reaction torques is identical, without counting the value of the friction of efficiency.

During a screw driving operation, the system formed by the handle housing 10, the handle and the internal mechanical elements therefore undergo two reaction torques in opposite senses and with equal intensities. The sum of the torque values transmitted to the handle housing is therefore zero or at least negligible. The reaction torque transmitted to the operator's hand by the handle 100 is therefore negligible. A screwdriver according to the invention therefore has great comfort and high safety of use.

The reaction torque transmitted to the handle housing 10 by the second sun gear 200 is measured by the torque sensor and the control box. This reaction torque is proportional to the tightening torque at which the element to be screwed in is screwed.

When the driving means, in this case the control box, detects that the value of this first reaction torque $CR_1$ has attained a first predetermined threshold value generally corresponding to the instant at which the element to be screwed makes contact with an element of the assembly to be made, the control box drives the stopping of the pre-screw driving phase and the starting of the screw driving phase.

The control box then actuates the means for inverting the sense of rotation of the motor. The sense of rotation of the motor 12 is thus inverted.

The drive shaft 15 is driven rotationally in the clockwise sense at a second speed that is slower than said screw driving speed. The first sun gear 161 is driven rotationally in the clockwise sense by the drive shaft 15. The first planetary gears 162 are driven in the counter-clockwise sense by the first sun gear 161. Since the ring 160 is kept at a stop within the gear reduction housing 11 via the second epicyclic train, the first planet carrier 164 rotates in the clockwise sense. The sun gear 169 then rotates in the clockwise sense and drives the planet gear 166 in the counter-clockwise sense while the planet carrier 168 rotates in the clockwise sense. The end member 17 also rotates in the clockwise sense so much so that the element to be screwed in undergoes a screw driving phase at a slower speed until the desired tightening torque is attained. The screwdriver then delivers a screw driving torque with a value greater than that of the pre-screw driving torque.

When the control box detects the fact that the first reaction torque $CR_1$ has reached a second predetermined threshold value corresponding to the end of the screw driving, it commands the stopping of the screwdriver.

An exemplary embodiment improves the safety of use and the ergonomy of screwdrivers with rotating handle housings.

An embodiment provides a screwdriver of this kind that causes no reaction on the operator's hand during the screw driving operation, or at least one that causes a reaction with a value low enough not to cause any injury and/or fatigue for the operator.

An embodiment implements a screwdriver of this kind which, in at least one embodiment, makes it possible to control the tightening torque with which a fastening element is screwed in by means of the screwdriver.

An embodiment provides a screwdriver of this kind which, in at least one embodiment, has a simple design and/or is reliable and/or inexpensive.

The invention claimed is:

1. A rotary screw driving tool comprising:

a handle housing comprising a handle and lodging a motor; and a gear reduction housing, said gear reduction housing lodging a gear reduction unit, an input of which cooperating with an output of said motor, said gear reduction unit comprising a single output cooperating with a rotating end element that is configured for cooperating with an element to be screwed, said gear reduction housing being linked to said handle housing by a rotating link, which is configured in a way such that a reduced reaction force is transmitted to said handle housing during an operation of screw driving, said rotating link comprising a transmission, which transmits to said handle housing a reaction torque having an intensity that is substantially identical, and a direction that is opposite, to that of the reaction torque transmitted by said gear reduction unit to said motor, said gear reduction unit comprising a first epicyclic gear train having a first sun gear interdependent with said motor, at least two first planet gears mounted on a first planet carrier, and a ring gear mounted freely in rotation in said gear reduction housing, said transmission comprising a second epicyclic train having said ring gear, a second sun gear mobile in rotation relative to said first sun gear and fixed to said handle housing, at least two second planet gears mounted on a second planet carrier, said second planet carrier being fixed to said gear reduction housing.

2. The rotary screw driving tool according to claim 1, wherein the number of gear teeth, respectively of the first sun gear and the at least two first planet gears are identical to those of the second sun gear and the at least two second planet gears.

3. The rotary screw driving tool according to claim 1, wherein the input of the first epicyclic train is said first sun gear and its output is said first planet carrier, and the input of said second epicyclic train is said second sun gear and its output is said second planet carrier, and said first and second trains have identical reduction ratios.

4. The rotary screw driving tool according to claim 1, wherein the first planet carrier is directly connected to the rotating end element.

5. The rotary screw driving tool according to claim 1, wherein the device comprises at least one torque sensor configured for measuring a piece of information representing a tightening torque of said element to be screwed, said at least one torque sensor being integrated into said transmission.

6. The rotary screw driving tool according to claim 5, wherein said torque sensor is mounted on said second sun gear.

7. The rotary screw driving tool according to claim 6, wherein said torque sensor integrates strain gauges.

8. The rotary screw driving tool according to claim 1, wherein the tool comprises a gearbox interposed between said motor and said gear reduction unit.

9. The rotary screw driving tool according to claim 8, wherein the tool comprises means for changing speed by inverting a sense of rotation of said motor.

10. The rotary screw driving tool according to claim 8 wherein an axis of said gearbox and of said gear reduction unit extends in parallel and in a way such that the axis is offset from an axis of said motor.

11. The rotary screw driving tool according to claim 1, wherein the tool comprises a reaction bar fixedly connected with said gear reduction housing, said reaction bar being designed to be placed so that it rests against a fixed element so that, during the screw driving operation, it absorbs the reaction torque of the tool.

* * * * *